United States Patent [19]

Rosenfeld et al.

[11] Patent Number: 4,810,206

[45] Date of Patent: Mar. 7, 1989

[54] LOCKING ELECTRICAL CONNECTOR

[75] Inventors: Seymour Rosenfeld, Monsey; Gino Antonini, Pelham, both of N.Y.

[73] Assignee: Kings Electronics Co., Inc., Tuckahoe, N.Y.

[21] Appl. No.: 101,143

[22] Filed: Sep. 25, 1987

Related U.S. Application Data

[63] Continuation-in-part of Ser. No. 934,675, Nov. 25, 1986, abandoned.

[51] Int. Cl.[4] ..... H01R 13/639

[52] U.S. Cl. ..... 439/325; 439/353

[58] Field of Search ..... 339/75 R, 75 B, 75 P, 339/91 R; 439/345, 350, 352, 353

[56] References Cited

U.S. PATENT DOCUMENTS

| | | | |
|---|---|---|---|
| 3,336,562 | 8/1967 | McCormick et al. | 339/91 R |
| 3,394,337 | 7/1968 | Miller | 339/91 R |
| 4,083,619 | 4/1978 | McCormick et al. | 339/75 M |
| 4,669,797 | 6/1977 | Bourdon | 439/353 |

FOREIGN PATENT DOCUMENTS

| | | | |
|---|---|---|---|
| 940537 | 12/1948 | France | 339/75 R |
| 964791 | 10/1950 | France | 339/75 R |
| 2447105 | 8/1980 | France | 339/91 R |

*Primary Examiner*—John McQuade
*Attorney, Agent, or Firm*—Jordan B. Bierman

[57] ABSTRACT

A locking electrical connector having male and female connector bodies forming a plug-in type assembly wherein the female connector body has at least one electrical terminal and the male connector body has at least one terminal-receiving socket in axial alignment therewith to form an electrical connection. The locking electrical connector has at least one pin and socket assembly for maintaining the connector bodies in locking connection with each other wherein a socket is on the female connector body. The male connector body has first and second chambers which exit into a recessed mating area and a plunger assembly capable of being displaced within the second chamber for movement therethrough. The pin is at the front end of the plunger assembly and capable of being positioned within the recessed mating area, and the socket is adapted to pass through the first chamber and contact the pin in positive locking engagement when the male and female connector bodies are engaged. A spring exerts a forward force on the plunger assembly to urge the pin in close proximity to the first chamber exit and a lever or trigger permits easy disconnection of the pin and socket assembly.

12 Claims, 4 Drawing Sheets

LOCKING ELECTRICAL CONNECTOR

This application is a continuation-in-part of application Ser. No. 934,675, filed Nov. 25, 1986 and now abandoned.

BACKGROUND OF THE INVENTION

The present invention relates to an improved locking electrical connector, and more particularly, to a pin and socket connector having locking means associated therewith to provide a positive and reliable electric contact between the connector bodies.

Pin and socket connectors are typically employed with electrical equipment because of their positive locking and easy release capability. The "quick connect/disconnect" feature of such devices is advantageous. However, it is desirable that the connection be sufficiently positive so that the connectors do not disconnect inadvertently, as current surges passing through the connector at the time of disconnection will damage the electrical equipment or the connector itself. Accordingly, it is desired that electrical connectors are provided with a positive means of connection and disconnection.

Additionally, one of the recurrent problems in the connector field is that, if the electrical terminals are not withdrawn carefully from the terminal-receiving sockets, the contact portion of the sockets may be distorted from its original configuration and take a permanent set. In this case, the opening of the socket may be enlarged or changed in some other manner from the preferred configuration and may not provide the best electrical connection during further use.

Various connector devices have been proposed heretofore for effecting a mechanical and electrical connection with a pin and socket terminal assembly. Johanson U.S. Pat. No. 3,275,970 teaches inserting a pin into a terminal head by exerting force on the cable termination. The device uses a spring to force the pin to remain in electrical contact with the terminal socket and complete the electrical path. However, if the spring force is greater than the level of frictional engagement between the mating terminal bodies, problems exist with this particular design (see Column 5, lines 53–72). The reference lacks the trigger component of the present invention which would help to provide a locking connection and alleviate this particular problem.

Londell U.S. Pat. No. 2,944,241 and Glowacz U.S. Pat. No. 3,493,917 disclose a head-catch assembly similar to that of the present invention. However, the socket uses "hook-fingers" for the purpose of retaining the pin in electrical contact. Accordingly, when the fingers hook around the pin head, one would not be able to merely pull the head back through the action of the lever of the present invention without inevitably damaging the fingers and causing early replacement thereof. Additionally, the locking mechanism is used as the means for providing the electrical connection.

Hennessey U.S. Pat. No. 3,529,276 discloses a lever for the manipulation of a plug-receptacle assembly. This engagement is triggered by a release button. The lever is connected to the sleeve of the connector by a pair of straps secured at each end by screws. When the lever is pivoted counter-clockwise, the interaction of the straps and the sides of the lever causes the sleeve to move forward. The forward position is then secured in place through the use of a lock button.

However, this device has the disadvantage that disconnection can easily occur by accidentally depressing the lock button. Furthermore, this device does not engage and disengage with the ease of the present invention, as the particular lever associated with the spring mechanism attached to the sleeve of the present invention is not present. Moreover, the reference lever is used to affirmatively insert and remove the pin to and from the socket.

It is accordingly the object of the present invention to provide an improved electrical connector having a highly reliable electrical and physical connection between the mating elements by the mechanical connection of a locking mechanism.

It is a further object of the invention to provide an improved electrical connector having a locking mechanism which engages and disengages easily through the use of a trigger mechanism and spring for urging the pin and socket of the locking mechanism into and out of physical contact with each other.

It is another object of the invention to provide an improved electrical connector wherein the elements of the locking mechanism are sturdily coupled together in a novel manner.

It is a still further object of the invention to provide an improved electrical connector which eliminates inadvertent disconnection of the connector bodies.

The locking mechanism of the present invention has a trigger-actuated plunger assembly as part of the male connector body. A pin is integrally formed on the front end of the plunger. A slotted socket is constructed integrally with the female connector body and passes through a tightly fitting chamber of the male connector body to contact the pin when the connector bodies mate. The slotted socket is formed of fingers having a large head. The pin is maintained in connection with the socket through a compressive forward force of a spring mounted within the trigger. As long as the pin remains within the slotted fingers of the socket, the interaction between the chamber and the outward force of the fingers will insure a positive locking engagement between the pin and socket and prevent the pin and socket and the mating bodies from disconnecting. When disconnection is desired, the pin can be temporarily retracted from the socket by "pinching" the trigger and moving it in a rearward direction, thereby rearwardly compressing the spring. The pin is automatically reconnected to the socket through the compressive forward force of the spring once the trigger is released. In this manner, damage caused to the sockets and terminals is less apt to occur.

BRIEF DESCRIPTION OF THE DRAWINGS

In the accompanying drawings, constituting a part hereof and wherein like reference characters denote like elements throughout the several views.

DETAILED DESCRIPTION OF THE PREFERRED EMBODIMENT

Figure 1:
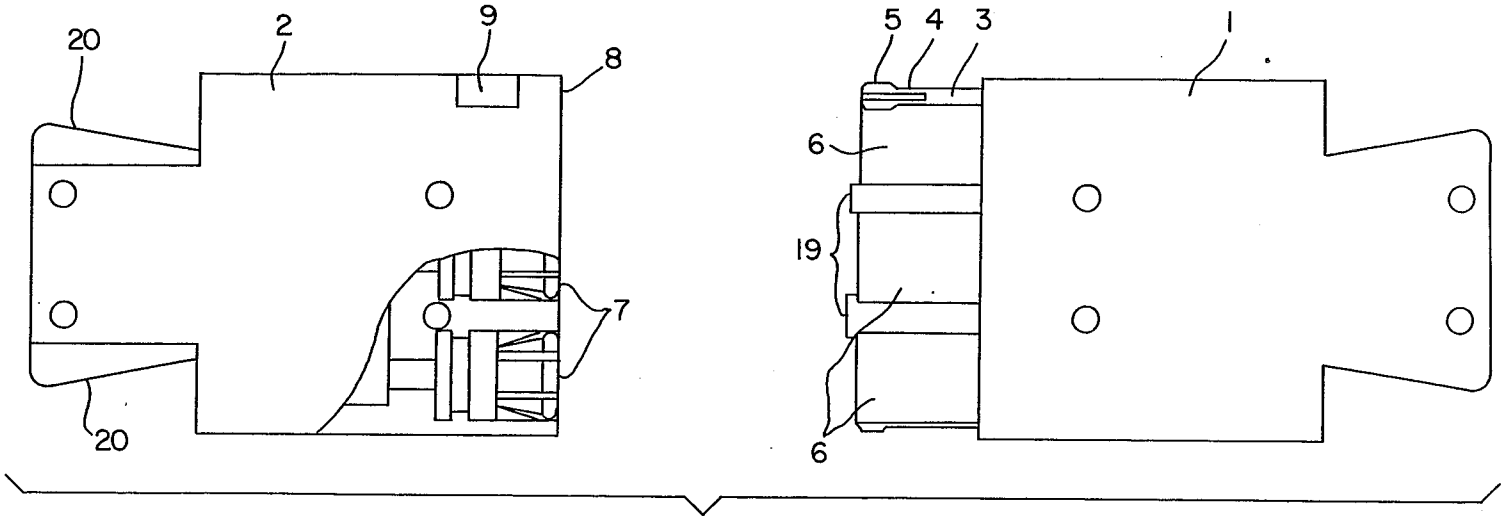
FIG. 1 is a plan view of the male and female connector bodies, partly in section.
Figure 2:
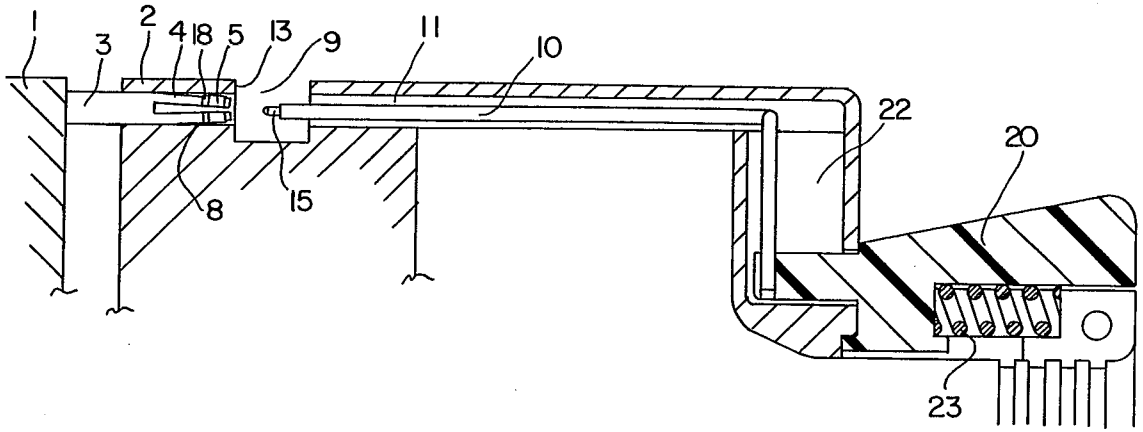
FIG. 2 is a cross-sectional view of the improved electrical connector wherein the pin is disengaged from the socket and the lever is not actuated.
Figure 3:
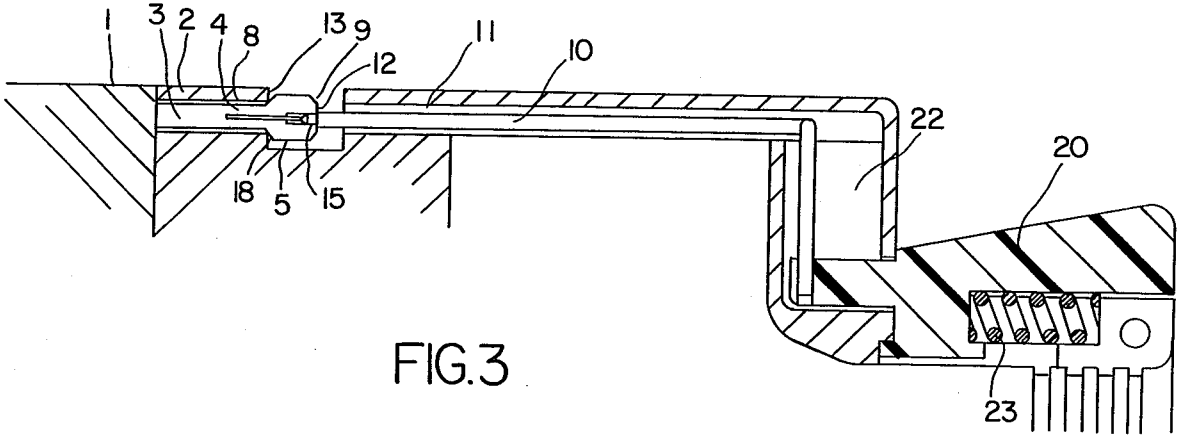
FIG. 3 is similar to FIG. 2 wherein the pin and socket elements are engaged.

Referring now to FIGS. 1-3, there is shown female connector body 1 adapted t be engaged with male connector body 2. Female connector body 1 is formed with at least one socket 3 comprising fingers 4 and socket head 5 which mechanically engage with the mating component of male connector body 2 to provide a positive, continuous electrical connection between electrical terminals 6 and terminal—receiving sockets 7 by simple, plug-in type assembly. The coupling of the unit is effected manually to facilitate quick and easy engagement and disengagement of the connector bodies to provide a sturdy but simple mechanical connection. Differing diameter lead guide pins 19 mating with corresponding receiving sockets (not shown) insure proper alignment of electrical and locking components.

An important feature is the trigger and the pin and socket combination wherein a mechanism for positively locking and easily unlocking male connector body 2 to female connector body 1 can be obtained. In this manner, electrical terminals 6 and terminal—receiving sockets 7 of the present invention will not wear out as quickly as the particular devices taught in the prior art.

As shown in FIG. 2 (and partly in FIG. 1), male connector body 2 is comprised of first chamber 8 which opens into recessed mating area 9. Plunger 10 moves axially through second chamber 11. Pin 15 is integrally formed on plunger 10 to form one end of the contact portion of the mechanical locking mechanism.

Figure 4:
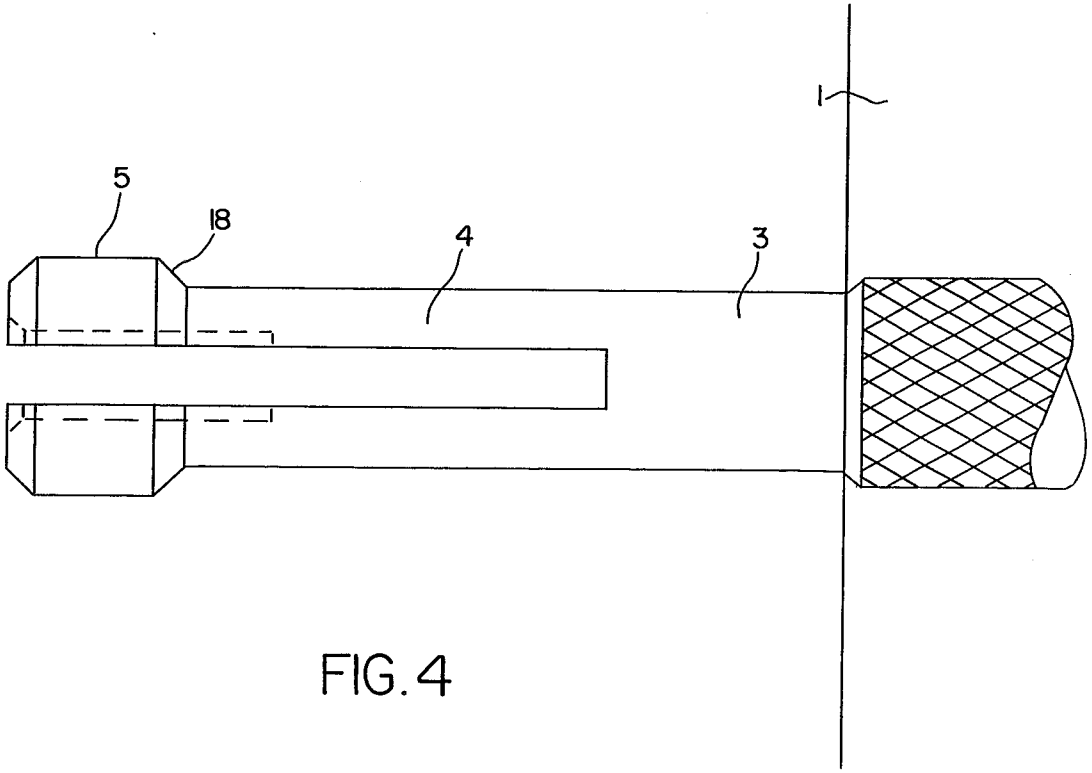
FIG. 4 is a cross-sectional view of the socket element.

When female connector body 1 is plugged into male connector body 2 (see FIGS. 1 and 2), socket head 5 of socket 3 (shown in greater detail in FIG. 4) enters into first chamber 8 causing fingers 4 to contract toward each other (see FIG. 2). When contracted fingers 4 pass through first chamber 8, they push pin 15 in a rearward direction, and compress spring 23 until socket head 5 exits first chamber 8 and enters into recessed mating area 9 to ultimately be in locking engagement with pin 15.

As shown in FIG. 3, after entering recessed mating area 9, fingers 4 will spread and the compressive force of spring 23 will insert pin 15 into socket head 5 of fingers 4. Accordingly, it will not be possible to pull female connector body 1 from male connector body 2, as fingers 4 will be prevented from contracting toward each other and exiting first chamber 8 due to the presence of pin 15 within socket head 5. Additionally, rear beveled edges 18 of socket heads will be in abutting relation to first chamber wall 13, making it impossible to pull socket 3 out through first chamber 8 without distorting the chamber wall. Therefore, a secure, positive lock is assured without the possibility of accidental disconnection.

When disconnection is desired, trigger 20 is "pinched" and moved in a rearward direction, causing plunger 10 to move in a similar fashion, thereby removing pin 15 from socket head 5. At this point, female connector 1 can be pulled away from male connector 2 because beveled edges 18 will slide against first chamber wall 13, causing fingers 4 to contract toward each other and permitting withdrawal of socket 3 through first chamber 8. As a result, the terminal portions of the connector bodies will not wear out quickly and are less likely to be damaged.

Plunger 10 is formed as an integral part of trigger 20. Plunger 10 is enclosed within male connector body 2 to form both third chamber 22 and the closed-end portion of second chamber 11.

When trigger 20 is rearwardly actuated to remove pin 15 from socket head 5, plunger 10 moves axially through second chamber 11 and third chamber 22, respectively, in the same rearward direction. When trigger 20 is released, front shoulder 12 moves into close proximity to first chamber wall 13 through the forward force of spring 23 which is contained within trigger 20.

Specifically, when contracted fingers 4 pass through first chamber 8, they will push pin 15 in a rearward direction and compress spring 23 until socket head 5 clears first chamber 8 and enters into recessed mating area 9. Fingers 4 will then spread and the compressive force of spring 23 will insert pin 15 into socket head 5 of fingers 4. The advantage to the location of spring 23 is that it will not be exposed in recessed mating area 9 and, therefore, is less likely to be damaged by external factors. Therefore, a secure, positive lock is assured without the possibility of accidental disconnection.

The above described embodiment is merely illustrative and not intended to limit the scope of the invention. Various changes may be made in the details of construction and arrangement of parts illustrated, as would be apparent to persons of ordinary skill in the art, without departing from the spirit and scope of the invention, which is not to be limited except by the character of the claims appended hereto.

What is claimed is:

1. In a locking electrical connector having male and female connector bodies forming a plug-in type assembly, said female connector body having at least one electrical terminal, said male connector body having at least one terminal-receiving receptacle in axial alignment therewith to form an electrical connection, the improvement comprising at least one pin and socket assembly for maintaining said connector bodies in locking connection with each other wherein a socket is on said female connector body, said male connector body comprising first and second chambers which exit into a recessed mating area, a plunger assembly capable of being displaced within said second chamber for movement therethrough, a pin being positioned at the front end of said plunger assembly and capable of being positioned within said recessed mating area, means for exerting a forward force on said plunger assembly to urge said pin in close proximity to said first chamber exit, said socket being adapted to pass through said first chamber when said male and female connector bodies are engaged and contact said pin in positive locking engagement, a second means for permitting easy disconnection of said pin and socket assembly.

2. The connector of claim 1 wherein said socket is slotted to provide a plurality of socket fingers forming a socket head.

3. The connector of claim 2 wherein said socket fingers are adapted to contract radially when passing through said first chamber of said male connector body, said contracted fingers capable of pushing said pin in a rearward direction as said socket head exits said first chamber into said recessed mating area, said socket fingers being adapted to spread to their original shape after said socket head exits from said first chamber.

4. The connector of claim 3 wherein said socket head is adapted to be positioned against a wall of said first chamber upon exit therefrom due to said spreading of said socket fingers, said pin being urged into contact with said spread socket head through said forward force of said exerting means, thereby preventing said socket fingers from being contracted toward each other and retracted from said first chamber while said pin is in said socket.

5. The connector of claim 4 wherein said second means comprises an actuating trigger movably mounted on said plunger assembly and capable of exerting a rearward force thereon, thereby causing said pin to be disengaged from said socket and permitting said socket to be retracted from said first chamber as a result of the radial contraction of said socket fingers and the removal of said pin therefrom.

6. The connector of claim 5 wherein actuation of said trigger causes a rearward force upon said exerting means, and wherein said forward force of said exerting means is adapted to cause said pin to return in close proximity to said first chamber exit when said trigger is released.

7. The connector of claim 6 wherein said exerting means is a spring.

8. The connector of claim 1 wherein said socket is an integral part of said female body.

9. The connector of claim 1 wherein said pin is an integral part of said plunger assembly.

10. The connector of claim 4 wherein said second means comprises an actuating trigger formed integrally with said plunger assembly capable of exerting a rearward force thereon to move said plunger assembly axially through said second chamber and a third chamber, respectively, when said trigger is pulled rearwardly, thereby causing said pin to be disengaged from said socket and permitting said socket to be retracted from said first chamber as a result of the radial contraction of said socket fingers and the removal of said pin therefrom.

11. The connector of claim 10 wherein actuation of said trigger causes a rearward force upon said exerting means, and wherein said forward force of said exerting means is adapted to cause said pin to return in close proximity to said first chamber exit when said trigger is released.

12. The connector of claim 1 wherein said exerting means is a spring.

* * * * *